US005274557A

United States Patent [19]

Moriya et al.

[11] Patent Number: 5,274,557

[45] Date of Patent: Dec. 28, 1993

[54] TEACHING AND PLAYBACK METHOD FOR WORK MACHINE

[75] Inventors: Yukio Moriya, Kanagawa; Toshio Yokoyama, Uji; Fujitoshi Takamura, Hirakata; Takumi Onoda, Kawasaki, all of Japan

[73] Assignee: Kabushiki Kaisha Komatsu Seisakusho, Tokyo, Japan

[21] Appl. No.: 720,502

[22] PCT Filed: Dec. 18, 1989

[86] PCT No.: PCT/JP89/01270

§ 371 Date: Jul. 29, 1991

§ 102(e) Date: Jul. 29, 1991

[87] PCT Pub. No.: WO90/07032

PCT Pub. Date: Jun. 28, 1990

[30] Foreign Application Priority Data

Dec. 19, 1988 [JP] Japan ..... 63-321785

[51] Int. Cl.[5] ..... G06F 15/20; E02F 9/22

[52] U.S. Cl. ..... 364/424.07; 364/167.01; 364/193; 37/348

[58] Field of Search ..... 364/424.07, 167.01, 364/180, 193; 37/DIG. 1, DIG. 20; 172/2, 4, 4.5; 414/699

[56] References Cited

U.S. PATENT DOCUMENTS 4,288,196 9/1981 Sutton, II ..... 172/4.5
5,065,326 11/1991 Sahm ..... 364/424.07
5,088,020 2/1992 Nishida et al. ..... 364/167.01
5,170,342 12/1992 Nakamura et al. ..... 364/180

FOREIGN PATENT DOCUMENTS 220534 12/1984 Japan .
172712 9/1985 Japan .
88804 4/1987 Japan .
1318621 12/1989 Japan .

*Primary Examiner*—Gary Chin
*Attorney, Agent, or Firm*—Richards, Medlock & Andrews

[57] ABSTRACT

A teaching and playback method for a work machine that is applicable to construction equipment such as a hydraulic excavator to automatize operation. Data on the operator's operation of work machine actuators is stored, and the stored data is reproduced so that the same operation as that by the operator is automatically performed. The method is adapted to effect exactly the same operation as what has been taught even when, during playback, the load on the actuators has varied from the level applied during the teaching. For this purpose, the pump discharge amount and the amounts of flow supplied to the actuators which are present during the teaching are stored. During playback, when the load has varied, and the pump discharge has changed, the engine output is controlled in such a manner that the actual pump discharge becomes equal to the amount stored during the teaching. When the flows supplied to the actuators have changed, the flow control valve provided in an inflow circuit is controlled in such a manner that the actual flows become equal to the amounts stored during the teaching. Thus, even when the load during playback has varied from the level during the teaching, the actuators can operate exactly as taught, without involving a discrepancy in the locus of operation.

20 Claims, 3 Drawing Sheets

TEACHING AND PLAYBACK METHOD FOR WORK MACHINE

BACKGROUND OF THE INVENTION

1. Field of the Invention

The present invention relates to a teaching and playback method for a work machine and, more particularly, to such a method capable of assuring that construction equipment such as a hydraulic excavator performs a playback operation exactly as has been taught, even when a variation has occurred in the load on the machine. The method thus enables the machine to operate with improved accuracy even in such an event.

2. Description of the Related Art

Recently, it has often been the case with construction machines that they are required to perform work by repeating a certain operation. This particularly applies to a hydraulic excavator which is required, by the nature of its work, to perform repeated operations during, for example, earth excavation or loading. On the other hand, automatization of construction machines has been propelled by recent development in electronics, as shown in, e.g., Japanese Patent Application No. 149647/1988 (an application previously filed by the same applicant). A conventional teaching and playback method intended to automatize a construction machine of the above-described type has the following arrangement. During teaching, a locus of the work machine is taught by converting, into an electrical signal, the amount by which a work machine operation lever (hereinafter abbreviated to "work machine lever") is operated to move the machine along the locus, and storing the signal in a memory. During reproduction driving, the stored data is read from memory so that the machine performs a playback operation, which is an operation exactly the same as the taught operation.

With the conventional method, however, the following problem may be encountered in the event that, during a playback operation, the load on the machine should vary from the level upon which the teachings have been formulated. When the load on the machine has varied, particularly when it has increased from the above-mentioned level, there is the risk that the engine output may fall short. The engine rotational speed drops, causing a corresponding drop in the pump discharge. The insufficient pump discharge causes the work machine to move along a locus different from what has been taught. Thus, the machine operates with degraded accuracy. If a load variation occurs during multiple-actuator operation in which a plurality of work machine actuators are operated, there is a risk that the amount of flow supplied to the actuators may change, also resulting in movement of the machine along a locus different from the taught locus, hence, in degraded accuracy of operation.

SUMMARY OF THE INVENTION

The present invention has been accomplished with a view to overcoming the above-described problem. It is an object of the present invention to provide a teaching and playback method for a work machine that is capable of assuring that a playback operation is performed exactly as specified during teaching, even when, during the playback operation, the machine has encountered a variation in the load from the level applied during the teaching.

In order to achieve the above-stated object, a teaching and playback method for a work machine according to the present invention comprises the steps of: effecting a teaching mode during teaching where an operation signal indicative of the operator's operation of a plurality of work machine actuators is stored, the mode being effected in such a manner as to store the pump discharge amount and the amounts of flow supplied to the actuators that are present during the teaching; effecting a playback mode in which the actuators are operated in accordance with the data stored during the teaching mode so that the actuators perform the same operation as that by the operator; and effecting a control mode in which, when a variation in the load has been detected during the playback mode, the output of the engine linked with the pump is controlled and the flows supplied to the individual actuators are adjusted in such a manner that the actual pump discharge and the actual flows supplied to the actuators become equal to the stored pump discharge amount and the stored actuator flow supply amounts, respectively.

The method according to the invention is such that, even when, during playback, the load changes to become different from the level applied during the teaching, pump discharge compensation through the engine output control, as well as compensation for the flows supplied to the actuators, enables a playback operation to be performed exactly as specified by the teaching. The method thus overcomes the above-described problem. For this purpose, the actual engine output during teaching is reduced to a level of the order of 80% of the rated output, thereby providing a certain margin. When, during playback, the load has increased, the variation in the load causes a drop in the actual engine output and a corresponding drop in the pump discharge. According to the present invention, when the pump discharge has dropped, the actual engine output is automatically increased to maintain the pump discharge at the amount that was present during the teaching, thereby assuring that the same operation as specified by the teaching will be performed. If a variation in the load has occurred during multiple-actuator operation, the method uses a pressure compensated flow control valve disposed in an inflow circuit through which the actuators are supplied with flow. The valve is operated to adjust, i.e., increase or decrease, the flows supplied to the actuators in such a manner that the actual flows will become equal to the amounts that were present during the teaching, thereby assuring that exactly the same operation as the taught operation will be performed.

Therefore, the method according to the present invention is capable of, in addition to various advantages inherent in a teaching and playback method, overcoming the problem conventionally encountered, i.e., a variation in the load causing a deviation in the playback movement, more specifically, a discrepancy in the locus of the work machine from that taught during teaching. The method overcomes the problem by maintaining, through engine output control, the pump discharge at a certain amount and by maintaining, through flow adjustment, the flows supplied to the actuators at certain amounts. Consequently, the operation during playback can be performed with improved accuracy. This is a great improvement in the automatization of work machines.

DESCRIPTION OF THE PREFERRED EMBODIMENTS

Certain embodiments of the present invention will now be described with reference to the drawings.

Figure 1:
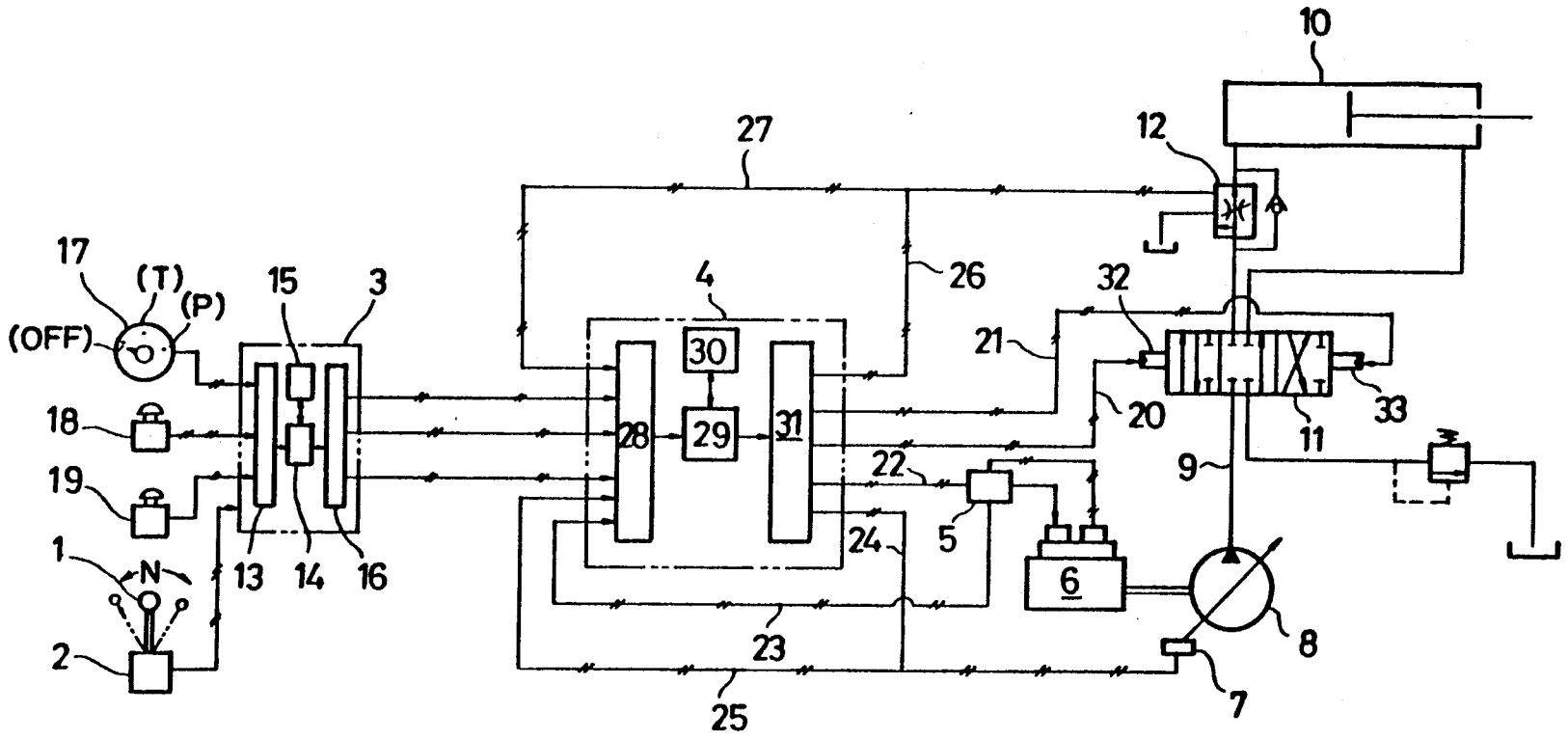
FIG. 1 is a circuit diagram of a circuit for the teaching and playback control of a work machine to which an embodiment of the present invention is applied.

FIG. 1 shows a circuit for the teaching and playback control of a work machine (not shown), such as a hydraulic excavator, to which an embodiment of the present invention is applied. The control circuit includes a work machine lever 1, a device 2 for converting the operation amount of the work machine lever 1 into an electrical signal, an automatization controller 3, an electronic controller 4, a device 5 for controlling the amount of fuel injected into an engine 6, and a variable-displacement pump 8 connected to the engine 6. The pump 8 has a regulator 7. An actuator 10, an electronic hydraulic valve 11 and a pressure compensated flow control valve 12 are connected to an inflow circuit 9 which is in turn connected to the pump 8.

Although not shown, the hydraulic excavator has a plurality of work machine pump levers, and a plurality of actuators corresponding thereto. Since the levers or the actuators have the same construction, only one of the levers and the corresponding actuator are illustrated and will be described so as to avoid reader's confusion.

The automatization controller 3 (hereinafter abbreviated to "AC") comprises an input interface 13, a circuit 14 for performing calculation and control on the basis of the signal inputted through the interface 13, a circuit 15 for storing processing procedures, constants, etc., and an output interface 16 for outputting the values obtained by the calculation and control. During teaching, the AC 3 converts the work machine lever operation amount into an electric signal, stores the signal, and performs the necessary calculation. During playback, the AC 3 transmits the stored data to the electronic controller 4 by generating an output signal.

The AC 3 is connected with switches 17, 18 and 19. The switch 17 is a mode changeover switch for changing from one of the manual mode (designated by OFF in FIG. 1), the automatic teaching mode (T), and the automatic playback mode (P), to another of these three modes. The switches 18 and 19 are each a teaching or playback ON/OFF switch for starting and terminating a teaching or playback operation.

The electronic controller 4 (hereinafter abbreviated to "EC") is connected, via signal circuits 20 and 21, with the electronic hydraulic valve 11. During playback, the EC 4 operates the valve 11 on the basis of the signal inputted from the AC 3 so as to control, through the actuator 10, a playback operation of the work machine. During playback, in order to cope with a variation in the load, the EC 4 receives feedback input signals and sends, on the basis of these input signals, command signals for the control of various members. For this purpose, the EC 4 is connected with the engine fuel injection control device 5 via input/output signal circuits 22 and 23, with the regulator 7 of the variable-displacement pump 8 via input/output signal circuits 24 and 25, and with the pressure compensated flow control valve 12 via input/output signal circuits 26 and 27. When a variation has occurred in the load during a playback operation, commands from the EC 4 cause the actual engine output and/or pump discharge to be controlled in proportion to a value indicative of the variation, so that the pump discharge will be maintained at the discharge amount that was present during the teaching. If a load variation has occurred during a multiple-actuator operation, the pressure compensated flow control valve 12 is controlled in a similar manner in proportion to a variation value, so that the flow supplied to the actuator 10 will be maintained at the flow supply amount that was present during the teaching.

Specifically, the EC 4 stores signals outputted from the pump 8 and the flow control valve 12 during the teaching. When a change in the discharge of the pump 8, caused by a variation in the load on the actuator, has been detected, the EC 4 operates to output an engine rotational speed adjusting signal to the fuel injection control device 5 of the engine 6 which is directly connected to the pump 8, thereby performing control in such a manner that the discharge of the pump 8 will become equal to the discharge amount that was present during the teaching. On the other hand, there are a plurality of actuators 10, each associated with a flow control valve 12 and an electronic hydraulic valve 11, which actuators 10 may be driven in a suitable combination thereof during a multiple-actuator operation. If such an operation is performed during playback, the actual flows which are present during the playback operation are compared with the flow amounts which were present during the teaching. The EC 4 performs control, with or without a variation in the load, in such a manner that the actual flows will become equal to the flow amounts during the teaching.

The EC 4 has a construction similar to that of the above-described AC 3, and comprises an input interface 28, a control circuit 29 for performing calculation and control on the basis of the signal inputted through the interface 28, a circuit 30 for storing processing procedures, constants, etc., and an output interface 31 for outputting the values obtained by the calculation and control.

Figure 2:
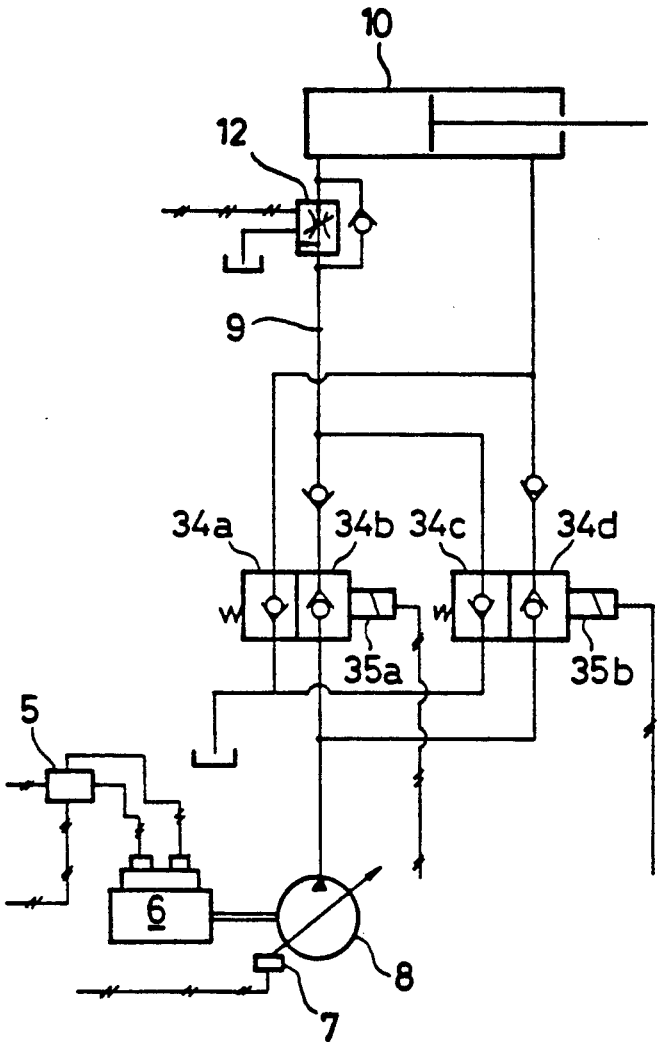
FIG. 2 is a circuit diagram of a control circuit having electronic poppet valves substituted for the electronic hydraulic valve of the circuit shown in FIG. 1.

The electronic hydraulic valve 11 is, as described above, used to control the operation of the actuator 10. A voltage indicative of the operation amount of the work machine lever 1 is inputted to the valve 11, and command currents are applied to two solenoids 32 and 33 of the valve 11, with the relationship of the command currents being calculated and controlled. The electronic hydraulic valve 11 may be substituted by electronic poppet valves 34*a* to 34*d*, as shown in FIG. 2. With this substitution, when signals expressing the command currents from the EC 4 are inputted to two solenoids 35*a* and 35*b*, a meter-in poppet valve 34*a* and a meter-out poppet valve 34*b* open in response to and in accordance with the signals, whereby a command flow in accordance with the command currents is supplied to the actuator 10.

Next, description will be given of the manner and procedure of operations performed by the teaching and playback control circuit.

(1) Teaching Operation

The teaching mode (T) is selected by switching the position of the mode changeover switch 17. Subsequently, the teaching switch 18 is turned on to start a teaching operation. When the work machine lever 1 is moved to the desired direction, the amount by which the lever is operated is inputted, as an electrical signal, to the AC 3, and is then stored therein. The electrical signal indicative of the lever operation amount is also inputted, through the EC 4, to the solenoids 32 and 33 of the electronic hydraulic valve 11. Through the control of the valve 11, the actuator 10 is operated in such a manner that the work machine moves along a predetermined locus, the machine thus being taught. The teaching mode is terminated by turning off the switch 18.

(2) Playback Operation

Prior to the start of a playback operation, the posture of the work machine is set. Thereafter, the mode changeover switch 17 is operated to select the playback mode (P). Then, the playback switch 19 is turned on, thereby starting a playback operation.

The playback operation is repeated until the playback switch 19 is turned off. When, during the playback, the load has varied from the level applied during the teaching, no special operation from the operator is required. Instead, the actual engine output is automatically controlled in such a manner as to maintain the pump discharge at the amount that was present during the teaching. When a load variation has occurred during a multiple-actuator operation, the pressure compensated flow control valve 12 is adapted to adjust the flows in such a manner that they are maintained at the amounts that were present during the teaching. Thus, the playback can be performed exactly as specified by the teaching.

When, during the playback, the operator operates the work machine lever 1, an additional signal is added to the AC 3 so that the electronic hydraulic valve 11 and the actuator 10 are operated in accordance with the additional signal as well.

Figure 3:
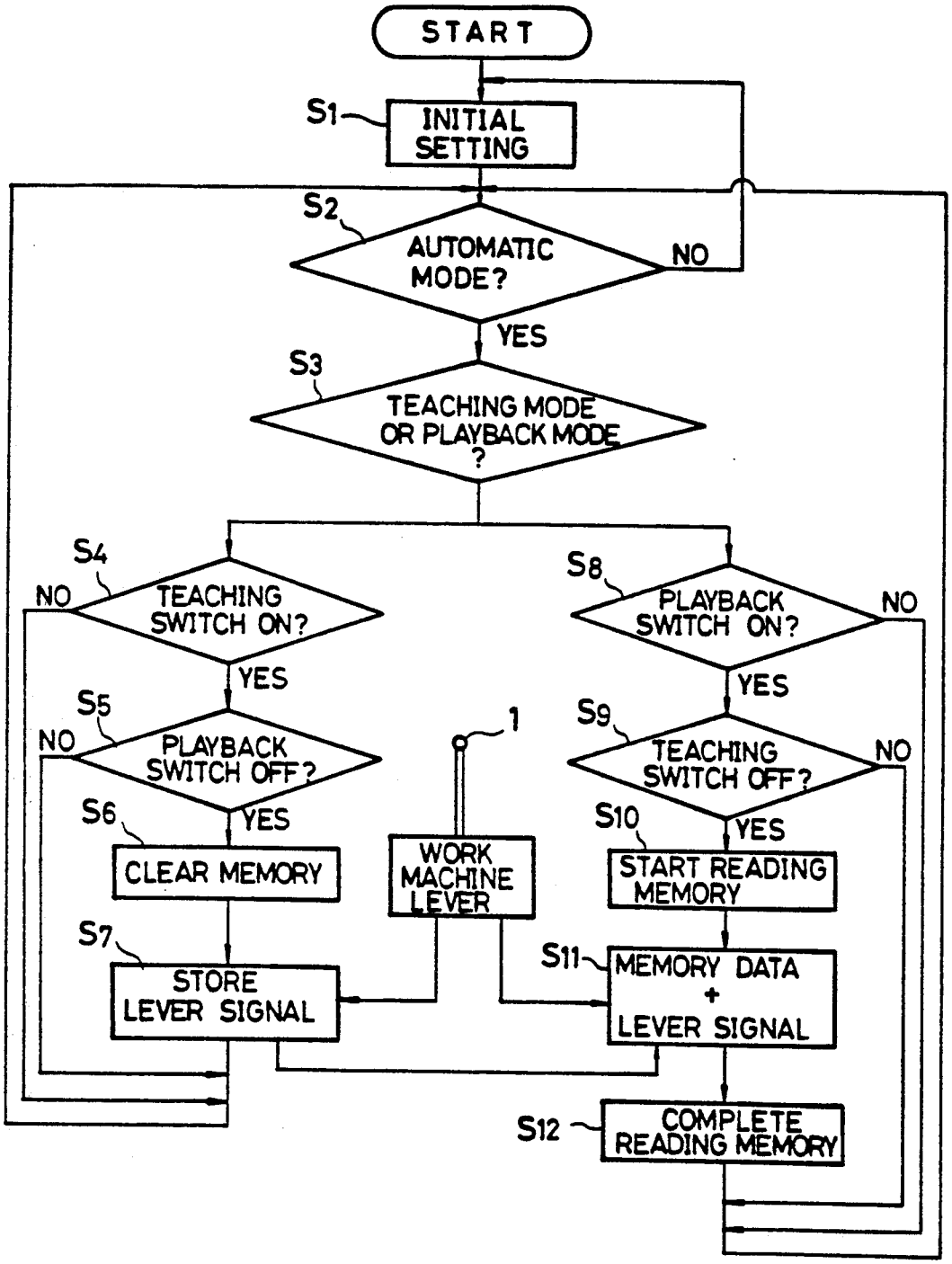
FIG. 3 is a flowchart showing control performed in the embodiment shown in FIG. 1.

FIG. 3 shows a flowchart illustrating the teaching and playback control. The flowchart shows basic procedures for carrying out a teaching and playback method for a work machine according to the present invention. In Step S1, initial setting is performed. A determination is made, in Step S2, as to whether or not the current mode is an automatic mode. If the current mode is an automatic mode, it is determined, in Step S3, whether it is the teaching mode or the playback mode.

If the current mode is the teaching mode, it is determined, in Step S4, whether or not the teaching switch is turned on, and, in Step S5, whether or not the playback switch is turned off. If affirmative answers are obtained in both of Steps S4 and S5, the memory of the electronic controller is cleared in Step S6. When a signal indicative of the operation of the work machine lever 1 has been inputted, the lever signal is stored (Step S7). The teaching mode is terminated when the teaching switch is turned off.

On the other hand, if the current mode is the playback mode, determinations are made as to whether or not the playback switch is turned on (Step S8) and whether or not the teaching switch is turned off (Step S9). If affirmative answers were obtained in both of Steps S8 and S9, the data stored in a memory of the electronic controller is read (Step S10). In Step S11, on the basis of the memory data, a driving signal is outputted to the electronic hydraulic valve 11. In this step, if an additional signal indicative of the operation of the work machine lever 1 has been added, this signal is also outputted to the valve 11. When the reading of the memory data has been completed, the playback operation is completed (Step S12).

INDUSTRIAL APPLICABILITY

The teaching and playback method according to the present invention is applicable to construction equipment. The method can be particularly advantageously applied to the hydraulic drive apparatus of a hydraulic excavator. The method is applicable to a work machine of any type which has an hydraulic drive apparatus and which is required to perform repeated operations.

What is claimed is:

1. A teaching and playback method for a work machine comprising the steps of:

effecting a teaching mode in which during teaching an operation signal indicative of the operator's operation of a plurality of work machine actuators is stored, the teaching mode being effected in such a manner as to store the pump discharge amount and the amounts of flow supplied to said actuators that are present during the teaching, the thus stored operation signal and the thus stored pump discharge amount and the amounts of flow supplied to said actuators that are present during the teaching constituting data;

effecting a playback mode in which said actuators are operated in accordance with said data stored during the teaching mode so that said actuators perform the same operation as that by the operator; and effecting a control mode in which, when a variation in the load has been detected during the playback mode, the actual output of the engine linked with the pump is controlled and the flows supplied to the individual actuators are adjusted in such a manner that the actual pump discharge and the actual flows supplied to said actuators become equal to the stored pump discharge amount and the stored actuator flow supply amounts, respectively.

2. A teaching and playback method for a work machine according to claim 1, wherein, in said teaching mode, the actual engine output is reduced to a value smaller than the rated output of the engine, said value is then stored as the actual engine output to be used during said playback mode, and wherein, in said control mode entered upon the detection of a variation in the load during said playback mode, the actual engine output is controlled.

3. A teaching and playback method for a work machine according to claim 1, wherein, in said control mode entered upon the detection of a variation in the load during said playback mode, the actual flows supplied to said actuators are adjusted by a pressure compensated flow control valve disposed in an inflow circuit connected to said actuators.

4. A teaching and playback method for a work machine having a hydraulic actuator, an electronically actuated valve, a pressure compensated flow control valve, a pump for providing fluid flow through said electronically actuated valve and said pressure compensated flow control valve to said hydraulic actuator, an engine for operating said pump, an operator actuatable work machine lever to produce operation signals for the operation of said hydraulic actuator via the manipulation of said electronically actuated valve, said method comprising the steps of:

(a) effecting a teaching mode by manually operating said work machine lever to produce said operation signals for the operation of said hydraulic actuator via the manipulation of said electronically actuated valve to achieve a certain operation of said hydraulic actuator, storing the operation signals produced by said work machine lever in the accomplishment of said certain operation, storing flow signals representative of the amounts of flow through said pressure compensated flow control valve to said hydraulic actuator that are present during said certain operation;

(b) effecting a playback mode by operating said electronically actuated valve in accordance with the thus stored operation signals for the purpose of repeating said certain operation; and (c) effecting a control mode by controlling the amounts of flow supplied to said hydraulic actuator in the playback mode so that the actual amounts of flow to said hydraulic actuator in the playback mode become equal to the amounts of flow to said hydraulic actuator represented by the stored flow signals even though the load on said hydraulic actuator during the repeating of said certain operation in the playback mode varies from the load on said hydraulic actuator in the teaching mode.

5. A teaching and playback method in accordance with claim 4 wherein the flow supplied to said hydraulic actuator is adjusted by said pressure compensated flow control valve.

6. A teaching and playback method in accordance with claim 4 wherein said teaching mode further comprises storing condition signals representative of the pump discharge amounts that are present during said certain operation; and wherein said control mode further comprises controlling the pump discharge so that the actual pump discharge amounts become equal to the pump discharge amounts represented by the stored condition signals.

7. A teaching and playback method in accordance with claim 4 wherein said teaching mode further comprises storing condition signals representative of the pump discharge amounts that are present during said certain operation; and wherein said control mode further comprises controlling the actual output of said engine to said pump so that the actual pump discharge amounts become equal to the pump discharge amounts represented by the stored condition signals.

8. A teaching and playback method in accordance with claim 4 wherein said teaching mode further comprises storing condition signals representative of the pump discharge amounts that are present during said certain operation; and wherein said control mode further comprises controlling the injection of fuel to said engine so that the actual pump discharge amounts become equal to the pump discharge amounts represented by the stored condition signals.

9. A teaching and playback method in accordance with claim 4 wherein said teaching mode further comprises operating, during said certain operation, the actual engine output at a value smaller than the rated output of the engine, and storing said value.

10. A teaching and playback method for a work machine having a hydraulic actuator, an electronically actuated valve, a pump for providing fluid flow through said electronically actuated valve to said hydraulic actuator, an engine for operating said pump, a device for controlling said engine, an operator actuatable work machine lever to produce operation signals for the operation of said hydraulic actuator via the manipulation of said electronically actuated valve, said method comprising the steps of:

(a) effecting a teaching mode by manually operating said work machine lever to produce said operation signals for the operation of said hydraulic actuator via the manipulation of said electronically actuated valve to achieve a certain operation of said hydraulic actuator, storing the operation signals produced by said work machine lever in the accomplishment of said certain operation, and storing condition signals representative of the pump discharge amounts that are present during said certain operation;

(b) effecting a playback mode by operating said electronically actuated valve in accordance with the thus stored operation signals for the purpose of repeating said certain operation; and (c) effecting a control mode by controlling the pump discharge during the playback mode so that the actual pump discharge amounts become equal to the pump discharge amounts represented by the stored condition signals even though the load on said hydraulic actuator during the repeating of the certain operation in said playback mode varies from the load on said hydraulic actuator during the certain operation in the teaching mode.

11. A teaching and playback method in accordance with claim 10 wherein said teaching mode further comprises operating, during said certain operation, the actual engine output at a value smaller than the rated output of the engine, and storing said value.

12. A teaching and playback method in accordance with claim 11 wherein the step of controlling the pump discharge during the playback mode comprises controlling the actual output of said engine to said pump during the playback mode so that the actual pump discharge amounts during the playback mode become equal to the pump discharge amounts represented by the stored condition signals.

13. A teaching and playback method in accordance with claim 11 wherein the step of controlling the pump discharge during the playback mode comprises controlling the injection of fuel to said engine so that the actual pump discharge amounts become equal to the pump discharge amounts represented by the stored condition signals.

14. A teaching and playback method in accordance with claim 11 wherein said pump is a variable displacement pump; wherein said work machine further comprises a regulator for said pump; wherein said device for controlling said engine controls the injection of fuel into said engine; wherein said teaching mode further comprises storing, during said certain operation, a signal from said regulator for said pump and a signal from said device for controlling said engine; and wherein the step of controlling the pump discharge during the playback mode comprises controlling the injection of fuel to said engine and controlling the position of said regulator for said pump so that the actual pump discharge amounts become equal to the pump discharge amounts represented by the stored condition signals.

15. A teaching and playback method in accordance with claim 11 wherein said pump is a variable displacement pump; wherein said work machine further comprises a regulator for said pump, and a pressure compensated flow control valve between said electronically actuated valve and said hydraulic actuator; wherein said device for controlling said engine controls the injection of fuel into said engine; wherein said teaching mode further comprises storing, during said certain operation, a signal from said regulator for said pump, a signal from said device for controlling said engine, and a signal from said pressure compensated flow control valve representing the amounts of flow through said pressure compensated flow control valve to said hydraulic actuator that are present during said certain operation; wherein the step of controlling the pump discharge during the playback mode comprises controlling the injection of fuel to said engine and controlling the position of said regulator for said pump so that the actual pump discharge amounts become equal to the pump discharge amounts represented by the stored condition signals; and further comprising applying a signal to said pressure compensated flow control valve so that the amounts of flow through said pressure compensated flow control valve to said hydraulic actuator during said certain operation in the playback mode will be maintained at the amounts of flow supplied to said actuator during the teaching mode.

16. A work machine having a teaching and playback capability, comprising a hydraulic actuator, an electronically actuated valve, a pump for providing fluid flow through said electronically actuated valve to said hydraulic actuator, an engine for operating said pump;

an operator actuatable work machine lever to produce operation signals for the operation of said hydraulic actuator via the manipulation of said electronically actuated valve;

means, responsive to the manual operation of said work machine lever in a teaching mode, to produce said operation signals for the operation of said hydraulic actuator via the manipulation of said electronically actuated valve to achieve a certain operation of said hydraulic actuator;

recording means for storing the operation signals produced by the manual operation of said work machine lever in the accomplishment of said certain operation in the teaching mode and for storing condition signals representative of the pump discharge amounts that are present during said certain operation in the teaching mode;

playback means for operating said electronically actuated valve in a playback mode in accordance with the thus stored operation signals for the purpose of repeating said certain operation;

control means for controlling the pump discharge during the playback mode so that the actual pump discharge amounts become equal to the pump discharge amounts represented by the stored condition signals even though the load on said hydraulic actuator during the repeating of the certain operation in said playback mode varies from the load on said hydraulic actuator during the certain operation in the teaching mode.

17. A work machine in accordance with claim 16 wherein the means for controlling the pump discharge during the playback mode comprises means for controlling the actual output of said engine to said pump during the playback mode so that the actual pump discharge amounts during the playback mode become equal to the pump discharge amounts represented by the stored condition signals.

18. A work machine in accordance with claim 16 wherein said pump is a variable displacement pump; wherein said work machine further comprises a regulator for said pump, and a device for controlling said engine; wherein said recording means comprises means for storing, during said certain operation in the teaching mode, a signal from said regulator and a signal from said device for controlling said engine; and wherein said means for controlling the pump discharge during the playback mode comprises means for applying a signal to said device for controlling said engine to control the injection of fuel into said engine, and means for controlling said regulator for said pump, so that the actual pump discharge amounts become equal to the pump discharge amounts represented by the stored signals from said regulator and from said device for controlling said engine.

19. A work machine in accordance with claim 16 wherein said pump is a variable displacement pump, wherein said work machine further comprises a regulator for said pump, a pressure compensated flow control valve between said electronically actuated valve and said hydraulic actuator, and a device for controlling the injection of fuel into said engine; wherein said recording means comprises means for storing, during said certain operation in the teaching mode, a signal from said regulator for said pump, a signal from said device for controlling the injection of fuel into said engine, and a signal from said pressure compensated flow control valve representing the amounts of flow through said pressure compensated flow control valve to said hydraulic actuator that are present during said certain operation; wherein the means for controlling the pump discharge during the playback mode comprises means for applying a signal to said device for controlling the injection of fuel into said engine to control the injection of fuel into said engine and means for controlling said regulator for said pump so that the actual pump discharge amounts become equal to the pump discharge amounts represented by the stored signals from said regulator and from said device for controlling the injection of fuel into said engine; and wherein said work machine further comprises means for applying a signal to said pressure compensated flow control valve so that the amounts of flow through said pressure compensated flow control valve to said hydraulic actuator during said certain operation in the playback mode will be maintained at the amounts of flow supplied to said actuator during said certain operation in the teaching mode.

20. A work machine having a teaching and playback capability, comprising a hydraulic actuator, an electronically actuated valve, a pressure compensated flow control valve, a pump for providing fluid flow through said electronically actuated valve and said pressure compensated flow control valve to said hydraulic actuator, an engine for operating said pump;

an operator actuatable work machine lever to produce operation signals for the operation of said hydraulic actuator via the manipulation of said electronically actuated valve;

means, responsive to the manual operation of said work machine lever in a teaching mode, to produce said operation signals for the operation of said hydraulic actuator via the manipulation of said electronically actuated valve to achieve a certain operation of said hydraulic actuator;

recording means for storing the operation signals produced by the manual operation of said work machine lever in the accomplishment of said certain operation in the teaching mode and for storing flow signals representative of the amounts of flow through said pressure compensated flow control valve to said hydraulic actuator that are present during said certain operation in the teaching mode;

playback means for operating said electronically actuated valve in a playback mode in accordance with the thus stored operation signals for the purpose of repeating said certain operation;

control means for controlling the amounts of flow to said hydraulic actuator during the repeating of said certain operation in the playback mode so that the amounts of flow to said hydraulic actuator in the playback mode become equal to the amounts of flow to said hydraulic actuator represented by the stored flow signals even though the load on said hydraulic actuator during the repeating of the certain operation in said playback mode varies from the load on said hydraulic actuator during the certain operation in the teaching mode.

* * * * *